United States Patent [19]

Ballard

[11] 4,226,327

[45] Oct. 7, 1980

[54] COMPOSITE PACKAGE

[75] Inventor: James L. Ballard, Tyler, Tex.

[73] Assignee: General Electric Company, Louisville, Ky.

[21] Appl. No.: 18,001

[22] Filed: Mar. 7, 1979

Related U.S. Application Data

[63] Continuation-in-part of Ser. No. 907,527, May 19, 1978, abandoned.

[51] Int. Cl.[3] ..... B65D 15/00; B65D 65/10; B65D 85/30

[52] U.S. Cl. ..... 206/320; 206/497; 206/586; 206/597; 229/23 R; 229/DIG. 12

[58] Field of Search ..... 206/320, 321, 497, 597, 206/586, 386, 521, 83.5; 229/DIG. 12, 33, 23 R

[56] References Cited

U.S. PATENT DOCUMENTS

| | | | |
|---|---|---|---|
| 2,094,448 | 9/1937 | Evans | 229/33 |
| 2,887,263 | 5/1959 | Wright | 229/23 R |
| 3,236,437 | 2/1966 | Johnson | 229/23 R |
| 3,433,402 | 3/1969 | Persson | 229/33 |
| 3,675,765 | 7/1972 | Melsek | 206/320 |
| 3,891,086 | 6/1975 | Isaacs | 206/320 |

*Primary Examiner*—William T. Dixson, Jr.
*Attorney, Agent, or Firm*—Frank P. Giacalone; Radford M. Reams

[57] ABSTRACT

The present invention relates to shipping package design for appliances and more particularly to a shipping container having a support portion made from corrugated fiberboard covering the top and at least one side of the appliance that is securely fastened to the appliance, and a shrink film covering the support portion and appliance to form an integral part of the support structure of the package.

2 Claims, 5 Drawing Figures

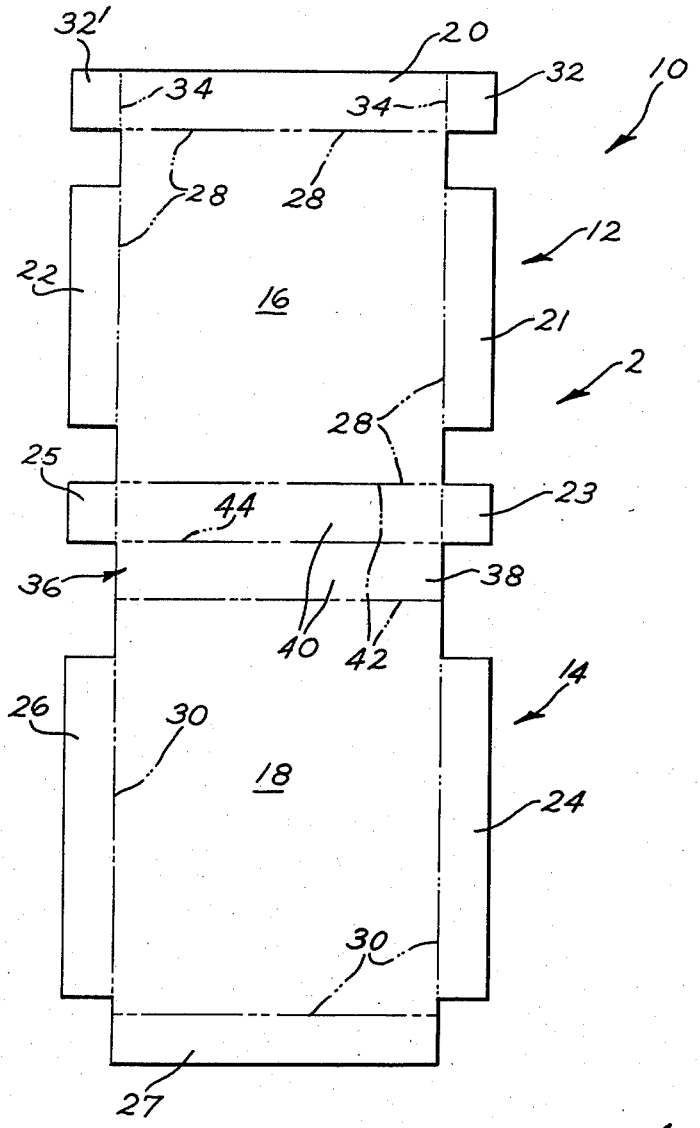
FIG. 2
FIG. 5
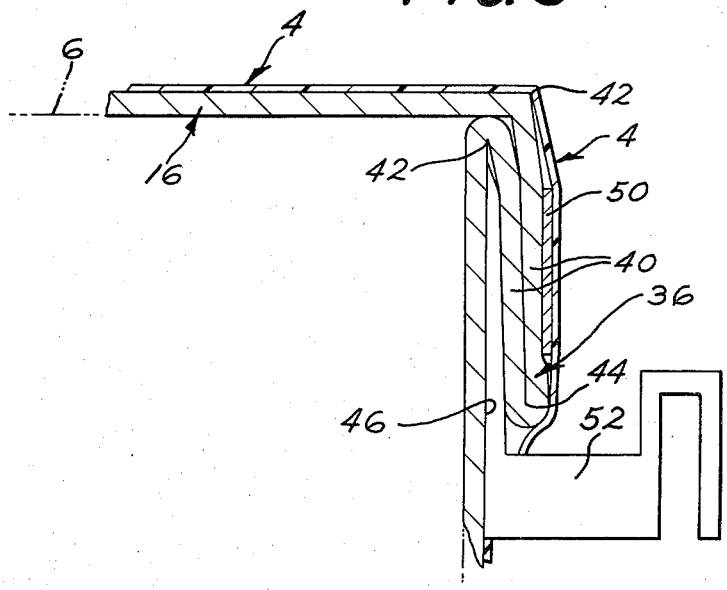

COMPOSITE PACKAGE

CROSS REFERENCE TO RELATED APPLICATION

The present Application is a continuation of U.S. Patent Application Ser. No. 907,527 filed May 19, 1978, for "Composite Package now abandoned."

BACKGROUND OF THE INVENTION

It is present day practice to package appliances in fiberboard cartons or packages during storage and shipping in order to protect the appliances against damage. Various types of corrugated fiberboard packaging arrangements have been devised in order to facilitate the storage and handling of these appliances. In order to take advantage of all shipping and warehousing space, it is desirable to be able to stack the cartons closely adjacent to one another with as little space between the adjacent cartons as possible. This usually requires some means for engaging the cartons from the front thereof when handling of the carton becomes necessary for movement of the appliance.

One satisfactory method of handling the cartons is to lift them from the top area by means of a lift truck having a spade or lift member which engages the carton. With such an arrangement, the operator of the truck does not require help in loading and unloading the cartons and the cartons may be stacked without any or a minimum amount of space left between them. It is common practice to provide a flap or fold in the top or cap of the carton under which the lift member of the truck is inserted. Many such top lifting cartons have been devised in which the top or cap of the carton is interlocked with the four sides of the carton, thereby transferring the force of the lift truck to the side through them to the bottom of the carton to lift the appliance packaged therein.

In other prior art methods it has been found unnecessary to completely enclose the appliances during warehousing and shipping. In fact, it is believed that cartons or crates that are open around the sides thereof decrease shipping and handling damage because they tend to promote greater care by the shipping and transfer personnel. They also reduce to a great extent the amount of fiberboard material necessary to form the shipping carton and therefore reduce substantially the cost of the carton. They also permit visual inspection of the appliance, without the necessity of removing it from its carton.

Various types of fiberboard cartons have been devised for encasing appliances. These cartons are normally provided with top and bottom caps over the top and bottom respectively of the appliances and a plurality of posts of fiberboard or other material disposed between the top and bottom caps along the edges of the appliances. In order to prevent stripping the top of the carton away from the appliance special structures have had to be devised as shown in U.S. Pat. No. 3,029,994-Chapman, assigned to General Electric Company, the same assignee as the present invention, for transferring the vertical force of the lift member from the top cap of the carton to the appliance and to the bottom cap for lifting the appliance.

It is therefore an object of the present invention to provide for an appliance an open-type carton having an improved structure which permits the carton and appliance to be lifted by means of a vertical lift member adapted to engage the upper portion of the carton.

SUMMARY OF THE INVENTION

The present invention provides a composite package for an appliance. The package includes a body member having a top element, and a front element, each having one edge disposed to intersect with each other, with the elements extending in a substantially perpendicular configuration therefrom. At least two sections are arranged between the elements intermediate the one edge of the elements. The two sections are folded to extend from the intersection and reversely bent to provide a support flange juxtapositioned relative to the outer surface of the front element. A first flange member is formed along a second edge portion of said top element opposite said support flange, and a second flange positioned on the bottom wall of the appliance adjacent its front wall. Holding means encompass the body member in engagement with the flange members and urge the first flange against the appliance and the support flange against said outer surface of the side element. An organic material sheet is arranged so that it encases the side and top elements and the holding means is shrunk thereabout to form a shrink-wrapped composite securely positioning the appliance between the top element and second flange of the body member.

DESCRIPTION OF THE DRAWINGS

FIG. 2 is a plan view of a blank from which the support portion of the package is formed;

FIG. 5 is a fragmentary sectional view similar to FIG. 4 showing the package being lifted.

DESCRIPTION OF THE PREFERRED EMBODIMENT

Figure 1:
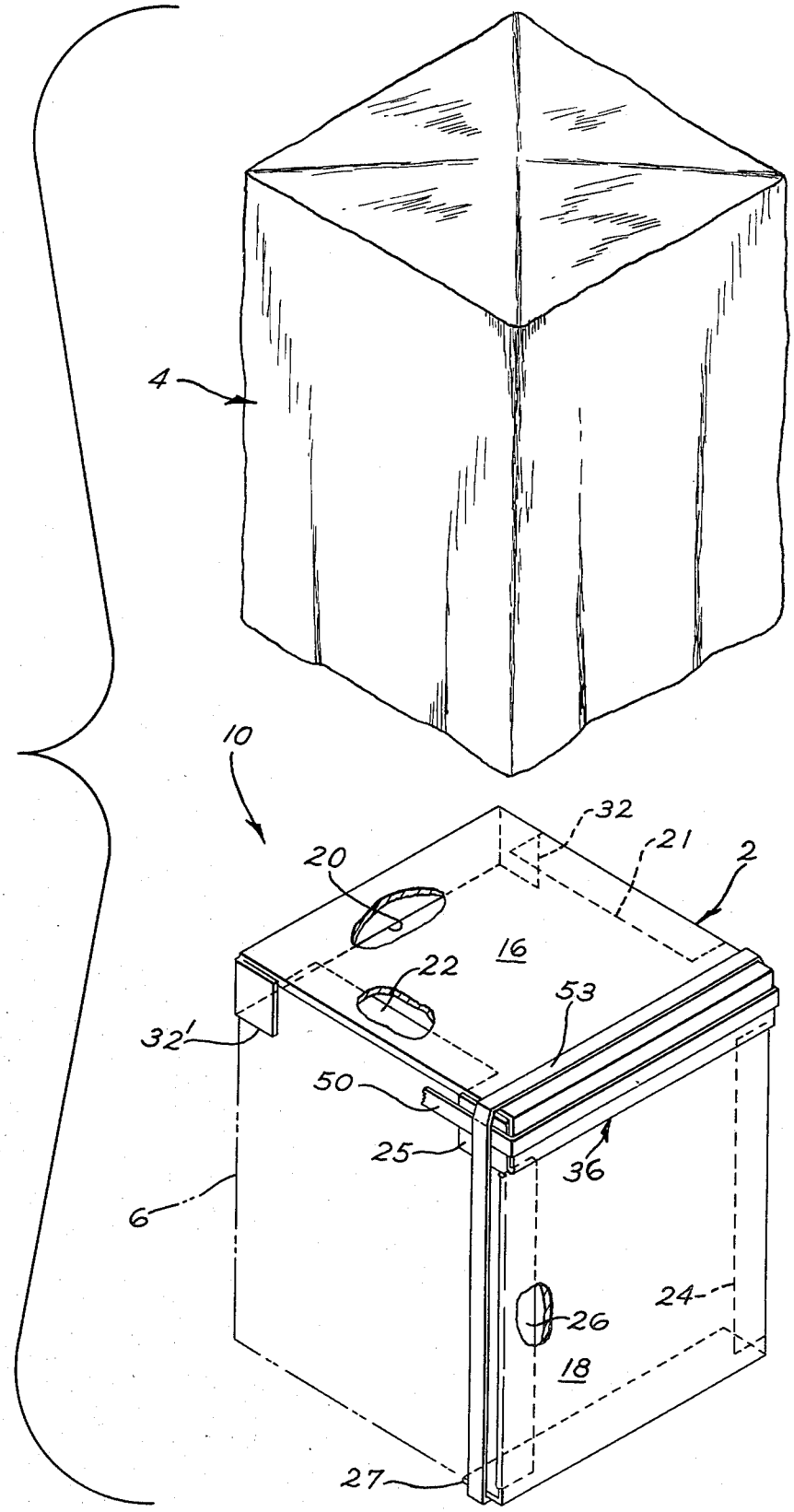
FIG. 1 is an exploded perspective view showing the parts of the present package.

The present invention as shown in FIG. 1 provides a package that includes essentially two parts, a support element 2 and cover element 4 which, as will be hereinafter explained, are arranged over an appliance 6 shown in dotted lines.

Referring now to FIG. 2, there is shown a fiberboard blank 10 from which the support element 2 is formed in the present embodiment. The blank is formed to include the top wall portion or section 12 and side or front wall portion or section 14 of the carton or package. The blank is preferably formed from a sheet of single-wall, double-spaced corrugated fiberboard; i.e., a fiberboard material having inside and outside plane surfaces which are joined together by means of a corrugated or undulating sheet disposed between them. This type of fiberboard, known as corrugated fiberboard, is commercially available and is widely used for shipping cartons. However, while fiberboard was used in carrying out the present invention, it should be apparent that other sheet material may be used.

The top and front portions 12 and 14 include central portions 16 and 18 respectively. Broken lines are used to indicate crease or fold lines on which bends may be made, and the solid lines used to indicate cuts entirely through the material.

Pieces are cut or otherwise removed from the blank 10 to form a plurality of flaps 20, 21 and 22 which are joined to and coextensive with the central portion 16 of top portion 12 and a plurality of flaps 23, 24, 25, 26 and flange 27 which are joined to and coextensive with the central portion 18 of the front portion 14. The flaps 20-22 are actually divided from the central portion 16 by score lines 28 which permit these flaps to be folded with respect to the central portion 16, while the flaps 23-26 and flange 27 are divided from the central portion 18 by score lines 30 which permit these flaps to be folded with respect to the central portion 18. The flap 20 is further provided with foldable portions 32, 32' which are divided therefrom by score lines 34 which are in alignment with score lines 28 and 30.

The package support element 2 is also provided with a support flange 36 which is formed from a portion 38 located in the blank 10 intermediate the top portion 12 and front portion 14 or more specifically central portions 16 and 18. Portion 38 includes two sections 40 defined by parallel score lines 42 defining the edge of portions 16 and 18 and a central score line 44.

Figure 3:
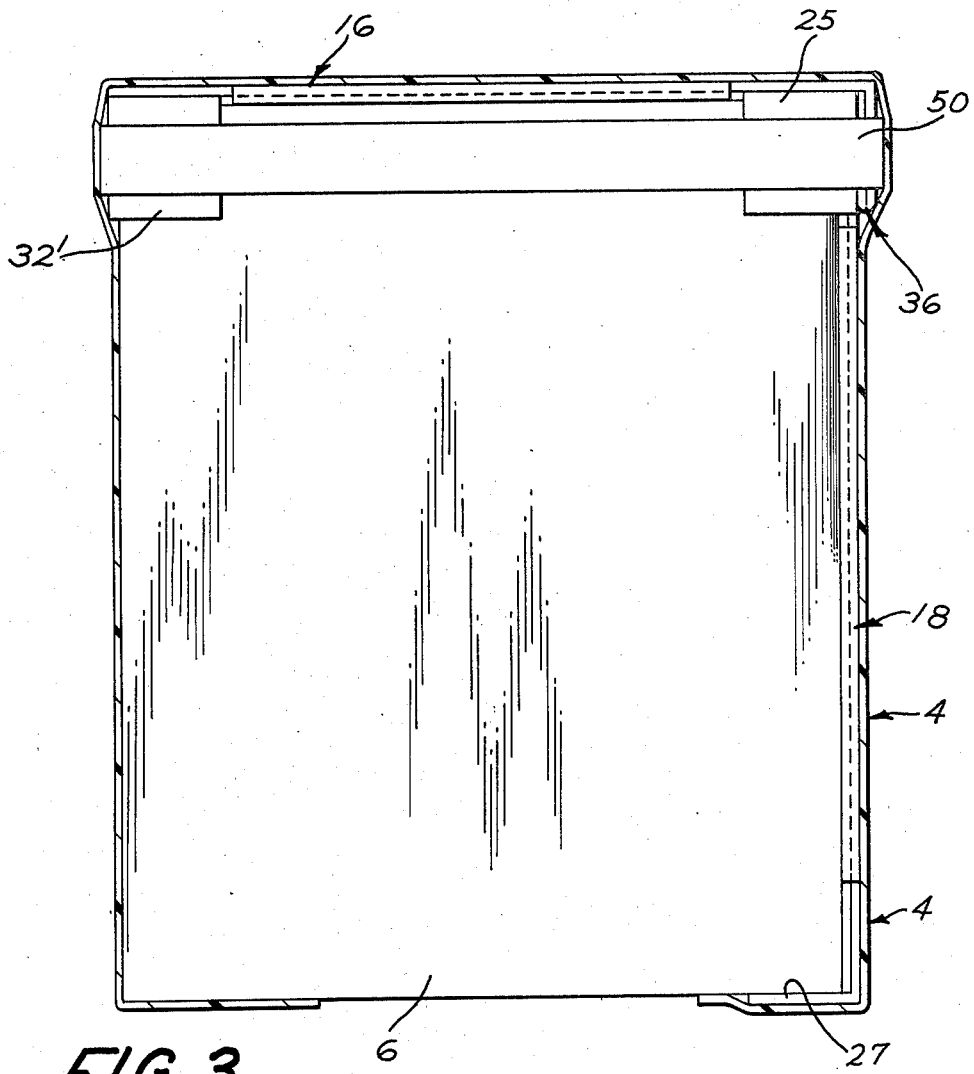
FIG. 3 is a side elevational view in section showing the appliance in the package.
Figure 4:
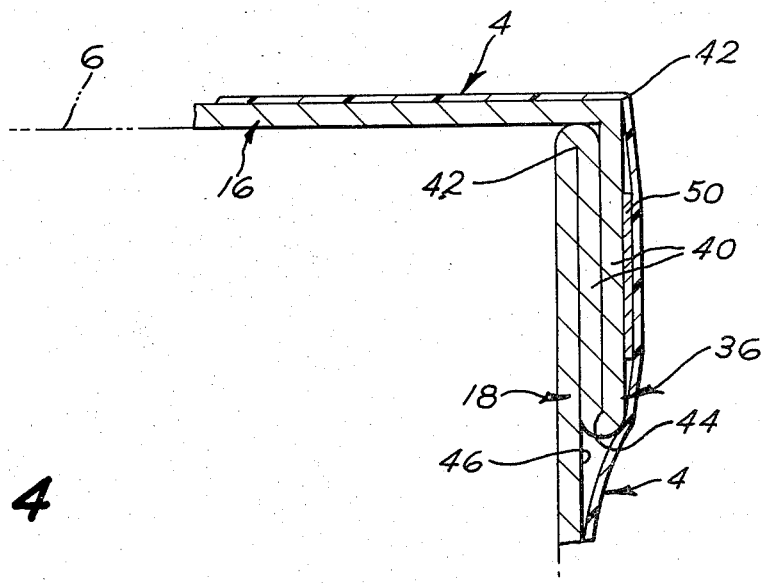
FIG. 4 is a fragmentary sectional view of a portion of the package.

The following is a description of the manner in which the blank 10 shown in FIG. 1 is formed into the support element 2 shown in FIGS. 2–4.

Referring to FIGS. 2–4 and particularly FIG. 4, the blank 10 is folded along score lines 42 and line 44 to bring the edge of central portions 16 and 18 defined by line 42 together into intersecting position with portions 40 folded upon each other to form the support flange 36. The flange 36 is then bent to be juxtapositioned against the outer surface 46 of the front central portion 18.

The flaps 24, 26 of front portion 14 and flaps 21 and 22 of top portion 12 are bent over onto the central portions 18 and 16 respectively to form a relatively ridged support portion along the horizontal side edge of top 16 and the vertical edge portion of front portion 18. The flaps 23 and 25 are bent to extend from portion 18 to engage the upper front corner of the appliance. The appliance 6 is placed over the flange 27 which is bent to a horizontal position, and front portion 18 and top portion 16 are arranged as shown in FIG. 3 adjacent the front and top wall respectively of the appliance. Flap 20 is bent to engage the upper portion of the back wall of appliance 6 with foldable portions 32, 32' bent to engage a portion of the upper side walls of appliance 6 adjacent the back corners. With the support portion 2 of the subassembled package including the top and front portions and flange 36 in place a suitable reinforcing means is provided to make certain that the flaps of the top and front portions are securely secured against the appliance to prevent movement therebetween. This is achieved in the present invention by providing a band or loop 50 of steel or other relatively strong flexible material. The band 50 is disposed entirely around the top portion and the flaps, including support flange 36 thereof and securely tightened in any suitable manner. The tightening of the band 50 forces the flaps and flange 36 to engage the appliance tightly, and prevent the inner portion of the flaps and front portion 18 from slipping relative to and dispensing from the appliance. If necessary, depending upon the weight and size of the appliance, a second band 53 as shown in FIG. 1 may be applied. Band 53 when applied would be arranged adjacent the front portion 18 and extend across the top 16 and under the flange 27 as shown in FIG. 1.

In this position, with the support member 2 so secured to the appliance, the subassembled package is encased in the organic cover portion 4 which is arranged over the appliance, and portion 2 with free ends of the cover extending beneath the appliance and flange 27 to completely cover the top, sides and a portion of the bottom of the subassembled package as shown in FIG. 3. The cover portion 4 is then shrunk to the subassembly. The organic sheet material can be, for example, low density polyethylene film having a thickness of about 4 mils which is shrunk to the subassembly by heat for forming a shrink-wrapped composite. In effect, the force applied by shrinking the cover element 4 over the subassembly securely holds the appliance 6 between the central top portion 16 and flange 27 as a unitary composite package that may be lifted through flange 36 as will be explained below.

In lifting the package a lift member 52 associated with a typical lift trunk is applied in a normal manner to the package. The lift member 52 engages the back wall of the package below the flange 36 and as it starts its upward movement the member 52 penetrates the relative thin sheet material of cover 4 as shown in FIG. 5 and positions itself between the outer surface 46 and the flange 36 so that continued upward movement of member 52 will raise the composite package. With the appliance firmly held between the central portion 16 and the flange 27, as stated above and shown in FIG. 3, the strength of the cover portion 4 is sufficient in most instances to maintain the integrity of the package. However, as stated hereinbefore, in those cases where it is not convenient to rely on the cover 4 the second band 53 may be applied.

In summary, by the present invention a composite package is provided which offers protection for the appliance by using only one blank member in developing a cover and support member that covers the top and only one side wall of the appliance. The one piece construction also offers advantages in the assembly operation of the package. Further, a composite package is provided that by use of a clear cover material offers a clear view of the appliance so that proper handling as well as damage resulting from improper handling or accident can be readily determined.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

I claim:

1. A composite package for an appliance comprising:

a one-piece body member including a top element positioned on the upper surface of the appliance and a front element positioned against one side wall of the appliance, each of said elements having one edge disposed to intersect with each other, with the elements extending in a substantially perpendicular configuration therefrom;

at least two sections are arranged between the elements intermediate the one edge thereof, said two sections being folded to extend from said intersection and reversely bent to provide a support flange integral with said elements being juxtapositioned relative to the outer surface of said front element;

a first flange member formed along a second edge portion of said top element being positioned against another side wall of said appliance opposite said one wall;

a second flange member formed along the bottom edge of said front member being arranged under the bottom wall of said appliance adjacent the front wall thereof so as to position said appliance between said top element and said second flange.

holding means arranged substantially horizontal on said package encompassing said body member in engagement with said flange members and urging said first flange against said appliance and said support flange against said outer surface of said front element for securing said appliance between said first flange and said support flange to form a subassembly of said composite package; and an organic material sheet encasing said subassembly and said appliance being shrunk thereabout to form a shrink-wrapped composite package to secure said appliance between said top element and said second flange whereby said composite package is lifted through said support flange.

2. The invention recited in claim 1 wherein a second holding means arranged substantially vertical encompassing said body member including said second flange member securing said appliance between the front edge portion of said top element and said second flange member.

* * * * *